United States Patent [19]

Tucker

[11] 4,081,061

[45] Mar. 28, 1978

[54] MODULAR LUGGAGE

[75] Inventor: Deborah E. Tucker, Boston, Mass.

[73] Assignee: Harrison Leather Goods Corporation, Boston, Mass.

[21] Appl. No.: 770,291

[22] Filed: Feb. 22, 1977

[51] Int. Cl.[2] ..... A45C 5/06

[52] U.S. Cl. ..... 190/52; 190/60

[58] Field of Search ..... 190/41 Z, 44, 52, 60

[56] References Cited

U.S. PATENT DOCUMENTS

| | | | |
|---|---|---|---|
| 2,536,169 | 1/1951 | Gray | 190/44 X |
| 3,061,057 | 10/1962 | Miller | 190/44 |
| 3,122,225 | 2/1964 | Ward | 190/52 |
| 3,291,266 | 12/1966 | Komroff | 190/43 X |
| 3,696,850 | 10/1972 | Rosenblum | 190/42 X |
| 3,830,348 | 8/1974 | Ohyama | 190/44 X |

*Primary Examiner*—Donald F. Norton

*Attorney, Agent, or Firm*—Wolf, Greenfield & Sacks

[57] ABSTRACT

A plurality of independent luggage pieces capable of functioning independently of one another and each having fastening means independent of their closures for securing the separate pieces together as a unitary structure as desired while being stored or in use.

26 Claims, 12 Drawing Figures

MODULAR LUGGAGE

INTRODUCTION

This invention relates to hand luggage and more particularly comprises a new and improved set of luggage composed of a number of separate pieces which may be either used separately and carried separately or which may be secured together so as to function as a unitary structure.

A set of luggage pieces may include a carry-on bag, overnight bag, garment bag, tote bag, brief case, etc. When traveling, each bag is handled separately, and they are checked as separate pieces when they are transported by a carrier. The traveler therefore frequently is required to keep track of a large number of separate luggage pieces.

The principal object of the present invention is to provide a set of luggage wherein the several individual pieces may at the selection of the user be handled as separate pieces or as a unitary structure wherein all of the pieces are assembled together. Such a luggage set has several advantages. First, while the separate pieces are capable of functioning independently of one another, they may be secured together while traveling to make the handling of the luggage more manageable. Furthermore the pieces may be selectively separated so that the user may ship certain of the pieces either to separate destinations or ship one or more pieces ahead for convenience.

To accomplish the principal and other objects of this invention, the set of luggage of this invention is composed of a number of individual luggage pieces each having its own handle and closure that enables each to be used in the conventional manner. Each piece includes fastening means independent of its own closure which allows it to be secured to any of the other pieces in the set. The fastening means are secured to the separate pieces adjacent the edges of the side panels and preferably are in the form of zippers that extend about several edges of the side panels. The handles for many of the separate pieces are secured to the side panels so that they may be confined to the space between the luggage pieces when the pieces are secured together, so as not to hang from the assembly to interfere with shipment or to become worn or mutilated.

In the preferred form of this invention the complete luggage set includes pieces of different sizes, and the fastening means is capable of securing more than one small piece to a single side panel of a larger piece and alternatively, the fastening means may be used to secure the smaller pieces together in face to face relation.

The main advantage of this invention is the interchangeability of its components. This luggage has more versatility than any other luggage, as the user can adapt the luggage to his particular needs on any trip, depending on its duration or special nature.

These and other objects and features of this invention will be better understood and appreciated from the following detailed description of one embodiment thereof, selected for purposes of illustration and shown in the accompanying drawing.

BRIEF FIGURE DESCRIPTION

DETAILED DESCRIPTION

Figure 1:
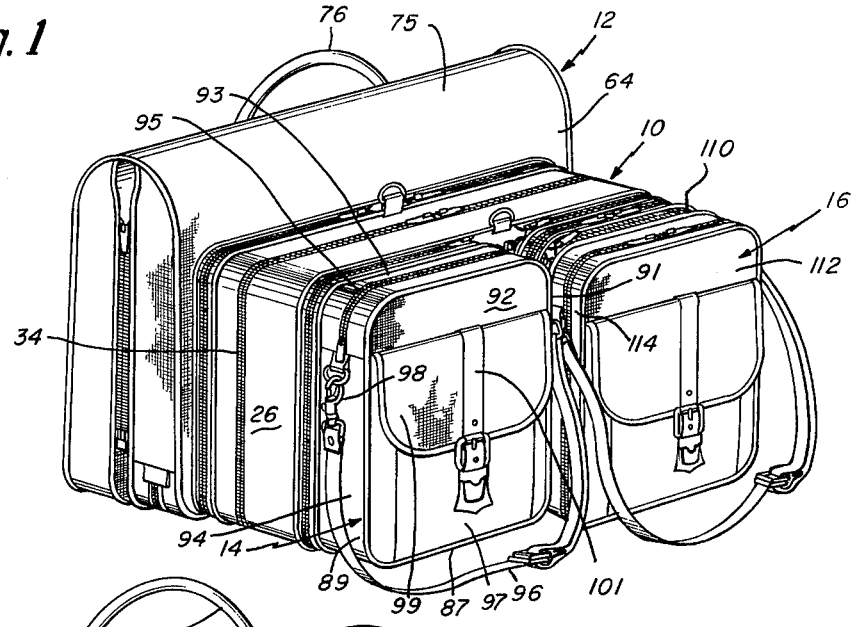
FIG. 1 is a perspective view showing a number of the luggage pieces secured together in a unitary assembly in accordance with this invention.

The assembly of luggage pieces shown in FIG. 1 includes a carry-on bag 10, a garment bag 12, a tote bag 14 and a tote-size bag 16 which in use may be expanded to a hand duffle bag.

Carry-on luggage bag 10 has a pair of side panels 18 and 20, and gusset 22 which defines the bottom 24, ends 26 and 28 and top 30. This bag, like the others, is generally made of a high quality, high strength nylon-like material having very great resistance to marring or tearing. Gusset 22 is secured to the side panels 18 and 20 by welting 32 that extends about the four sides of the side panels.

Carry-on bag 10 also includes a closure zipper 34 that extends about the two ends 26 and 28 as well as the top 30 of the gusset. Closure zipper 34 preferrably has two slides which meet at the center of the gusset top 30 when the zipper is closed. Bag 10 also has a pair of strap like handles 36 and 38 whose ends are sewn respectively to the outer faces of side panels 18 and 20 of the bag, which enables the gripping portions to hang down on the faces of the panels when they are not engaged.

Figure 2:
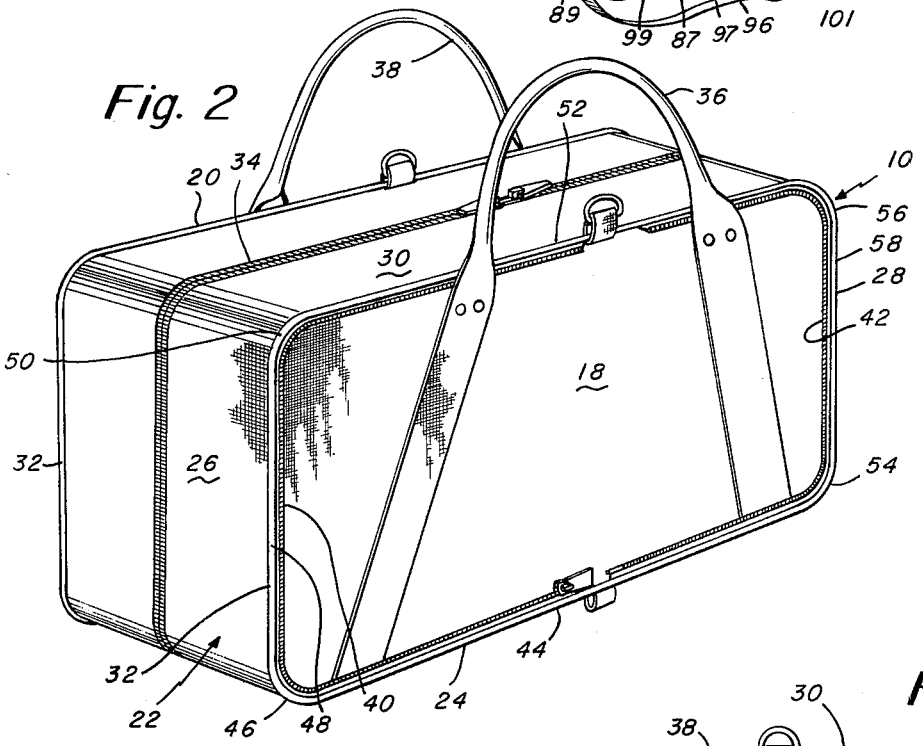
FIG. 2 is a perspective view of a carry-on bag constructed in accordance with this invention.

The means for securing the carry-on bag 10 to other bags of the set comprises, in the preferred form, a pair of U-shaped zipper elements attached to both its front and back side panels 18 and 20 by the welting. Thus, in FIG. 2 it will be noted that two U-shaped zipper elements 40 and 42 are secured to the welting which joins the side panel 18 with the gusset 22. Zipper element 40 extends from adjacent the midpoint of the welting at the lower edge 44 of side panel 18 to the lower corner 46, then upwardly along the side edge 48 of side panel 18 to upper corner 50 and then to the midpoint of the upper edge 52 of the side panel. Zipper element 42 which essentially mirrors zipper element 40 extends from the midpoints of the upper and lower edges 44 and 52 to the opposite corners 54 and 56 and along the other side edge 58 of side panel 18.

Figure 3:
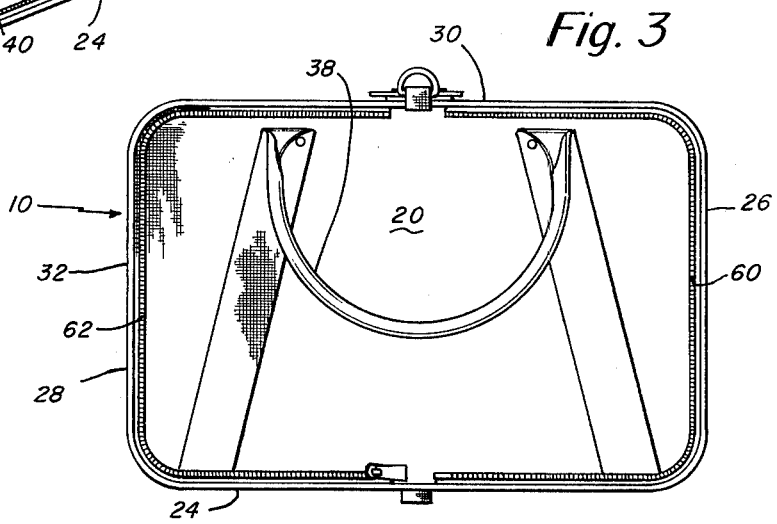
FIG. 3 is a rear elevation view of the carry-on bag shown in FIG. 2.

In accordance with the preferred form of this invention as shown in FIG. 3, identical attaching zipper elements 60 and 62 are secured about the edges of side panel 20 by means of the welting which secures that side panel to gusset 22. Zipper elements 60 and 62 respectively mirror the zipper elements 40 and 42 on the other side panel of the bag.

Figure 4:
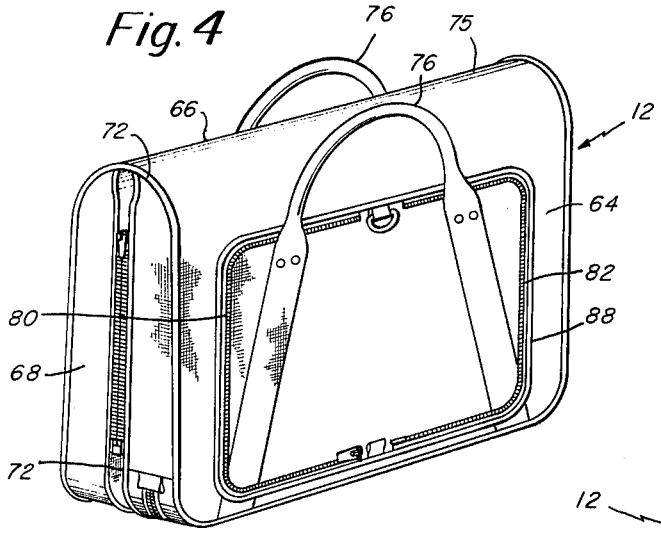
FIG. 4 is a perspective view of a garment bag constructed in accordance with this invention shown in its folded configuration.
Figure 5:
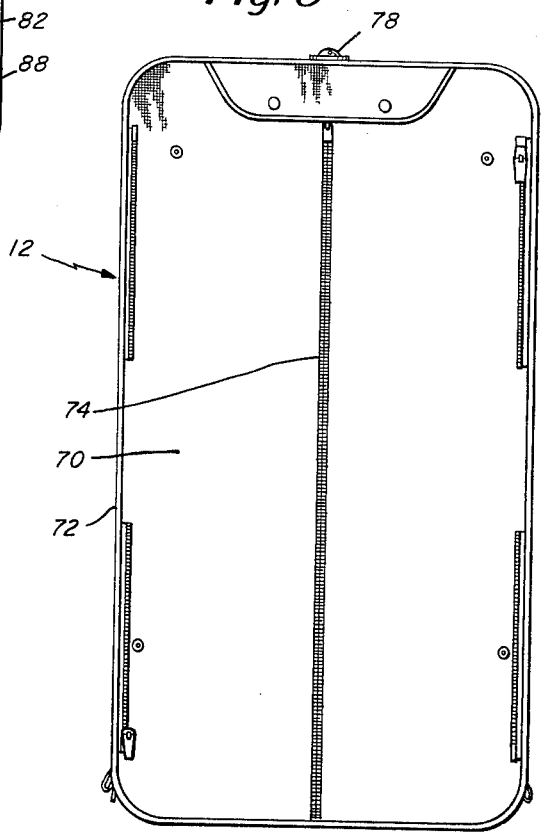
FIGS. 5 and 6 are front and back plan views of the garment bag, in its unfolded configuration.
Figure 6:
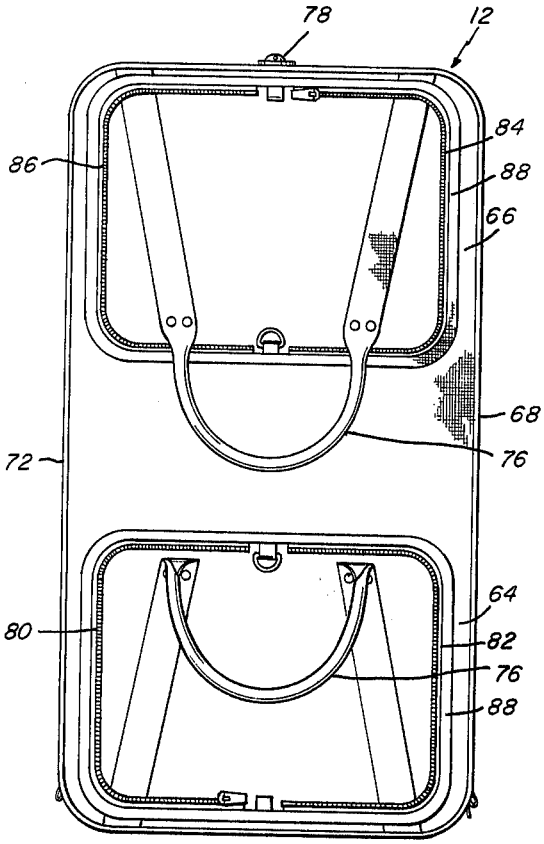

The garment bag 12 is shown in FIGS. 1 and 4 in the folded configuration. It is shown unfolded in FIGS. 5 and 6. The garment bag includes a pair of outside panels 64 and 66, gusset 68 and foldable inside panel 70. Gusset 68 is attached to the outside panels 64 and 66 and the foldable inside panel 70 by welting 72. The bag closure conventionally is a zipper 74 provided in the inside panel 70 which forms the front panel when the bag is unfolded. Closure zipper 74 extends substantially the full length of the bag as shown. Its particular configuration does not form part of this invention.

Top portion 75 of the garment bag separates the outside panels 64 and 66. In the form shown the bag includes handles 76 like the carry-on bag handles 36 and 38 for carrying the garment bag in the folded configuration. A hanger 78 is pivotally secured to the gusset 68 so that the garment bag may be hung upright in an unfolded configuration when not being transported.

The outside panels 64 and 66 of the garment bag each carry a pair of U-shaped attaching zipper elements 80, 82, 84 and 86 respectively, which are identical in size with the pairs of zipper elements 40, 42 and 60, 62 on the side panels of the carry-on bag. However, because the garment bag is slightly larger in elevation in the folded configuration than the carry-on bag 10, the attaching zipper elements 80, 82, 84 and 86 are not secured to the side panels by means of the welting 72 but rather are secured to the side panels by separate binding strips 88.

When the garment bag is detached from the other bags in the set, it is apparent from an examination of the drawings that it may be used in conventional fashion. However, by means of the attaching zippers on either of the outside panels 64 and 66 the garment bag may be attached face to face to the side panels on either side of carry-on bag 10. In FIG. 1, the garment bag is shown with its outside panel 64 attached in face to face relationship with the side panel 20 of the carry-on bag by means of the attaching zipper elements. It will be understood that one zipper element of each pair of zipper elements on each panel carries a slide so that when the bags are placed face to face and secured together the attaching zipper elements properly mate. Thus, for example, element 80 on the garment bag and element 62 on the carry-on bag have slides while elements 82 and 60 do not.

In FIG. 1 tote bag 14 and tote-size duffle 16 are shown. These two bags together, as is apparent in FIG. 1, when placed side by side are substantially equal in combined height and width to the side panels 18 and 20 of carry-on bag 10. Tote bag 14 shown in detail in FIGS. 1 and 7 includes a rear side panel 90 and front panel 92, and gusset 94 extends between the panels 90 and 92 to form a bottom 87, ends 89 and 91 and top 93. A closure zipper 95 extends about the ends and top of the gusset to provide access to the interior of the tote bag. The bag also has a pocket 97 closed by flap 99 and strap 101 on the front panel 92, and tote bag 14 further includes a detachable strap type handle 96 that is secured by clips 98 to the gusset side panels 89 and 91 respectively.

Figure 7:
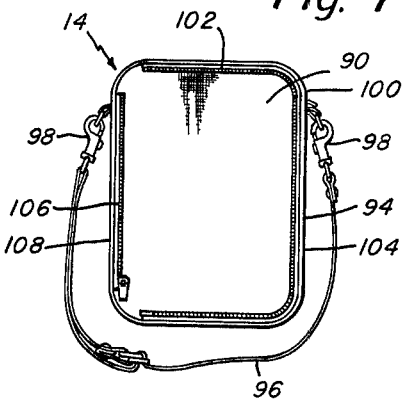
FIG. 7 is a back view of a tote bag constructed in accordance with this invention.

Welting 100 as shown in FIG. 7 secures the rear side panel 90 to gusset 94 and also secures attaching zipper element 102 to the tote bag. Zipper element 102 extends along substantially the full top and bottom edges of the rear side panel 90 and along one side edge 104 of that panel. It will be appreciated that the attaching zipper element 102 is identical in size to each of the U-shaped attaching zipper elements described above and carried on the side panels of the carry-on and garment bags 10 and 12. And the zipper element 102 on the tote bag is such that it can be mounted with its rear side panel facing the side panels of either the carry-on or garment bag, as desired by the user.

Tote bag 14 carries yet another attaching zipper element 106 attached to the welting 100 along side edge 108 of rear side panel 90. Unlike zipper element 102, zipper element 106 has no corresponding or mating zipper on either the carry-on or garment bag. Rather, its mating zipper is carried on the tote-size duffle 16 as explained below.

Figure 10:
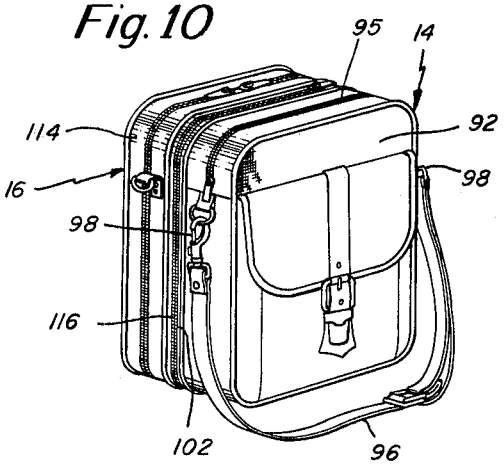
FIG. 10 is a perspective view showing two tote-size bags secured together in face to face relationship independently of the other bags in the set.
Figure 11:
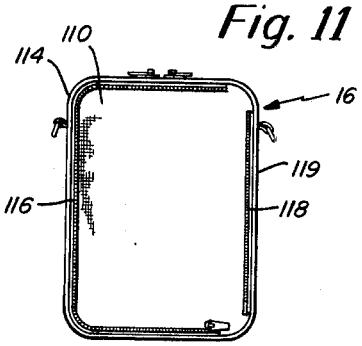
FIG. 11 is a rear view of an expandable tote-size bag.

Tote-size hand duffle 16 shown in FIGS. 1, 10 and 11 has a rear panel 110, front panel 112 and gusset 114. In exterior size and appearance, the bag 16 is substantially identical to tote bag 14. As indicated above, this bag is expandable by means of an added panel (not shown) in the bag, but that feature forms no part of the present invention and is not shown or further described. The tote-size hand duffle has a first U-shaped attaching zipper element 116 which is a mirror image of attaching zipper element 102 on tote bag 14. And the tote-size duffle also has a straight attaching zipper element 118 which is substantially identical to the attaching zipper 106 on the tote bag.

The tote bag 14 and tote size hand duffle 16 may be used in any of three different ways. First, each may be used individually and separately from the other bags of the set to perform its normal expected function. The two bags may also be secured side by side as shown in FIG. 1 to the side panel of the carry-on bag. When secured in that manner, the attaching zipper elements 102 and 116 of the tote bag and tote-size duffle respectively are attached to the mating attaching zipper elements 40 and 42 on side panel 18. When the two bags are secured in that fashion, the straight attaching zipper elements 106 and 118 on side edges 108 and 119 are secured directly together so that the two smaller bags form a stable assembly on the carry-on bag. While each has a strap handle as shown in FIG. 1, those handles may be removed if desired by means of clips 98. It will be appreciated that the two bags 14 and 16 may also be secured on the other side panel 20 of the carry-on bag 10 or to either outside panel of the garment bag in the same fashion.

In addition, the tote bag and tote size duffle can be secured in face to face relationship as shown in FIG. 10. When secured together in that fashion, the attaching zipper elements 102 and 116 are mated together as are the straight attaching zipper elements 106 and 118.

Figure 8:
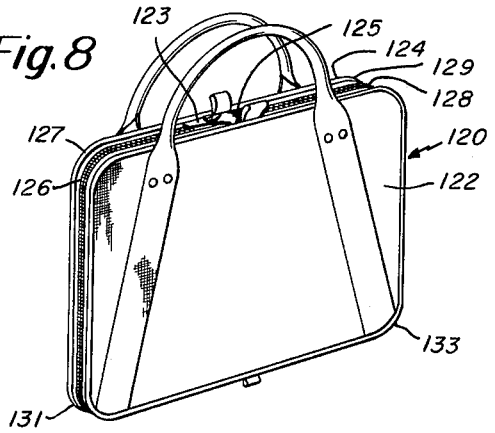
FIG. 8 is a perspective view of a brief case constructed in accordance with this invention.
Figure 9:
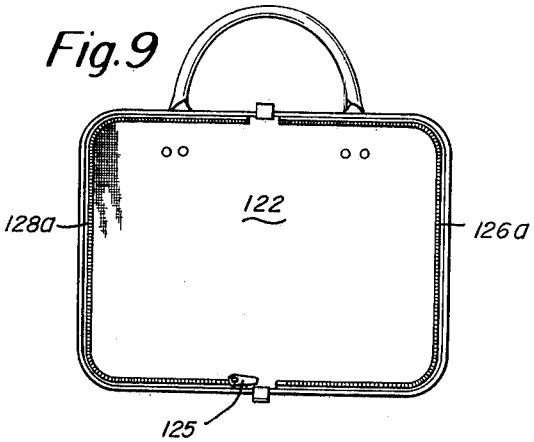
FIG. 9 is an inside elevation view of one of the panels of the brief case of FIG. 8.
Figure 12:
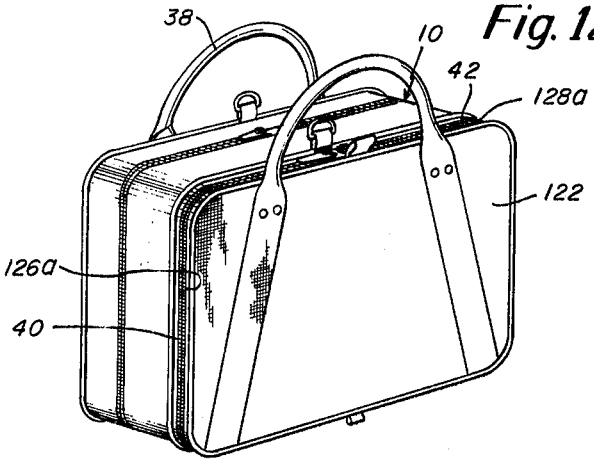
FIG. 12 is a perspective view of a single brief case panel attached to a carry-on bag.

In FIGS. 8 and 9 brief case 120 is shown composed of a pair of side panels 122 and 124. When the brief case is used as a separate bag, the panels 122 and 124 are secured together by the edge zippers 126 and 128. When the brief case is closed, the slides 123 and 125 of the zippers are located at the top of the bag so that the bag may be opened readily by moving the two zipper slides to or beyond the top outside corners 127 and 129. The two panels 122 and 124 may be completely separated by fully opening the zippers 126 and 128 that extend around the entire periphery of the case. Each of the zippers 126 and 128 is U-shaped, with each U having its bite extending along one full side edge of the side panel while the arms of the U extend from the corners 127, 129 and 131, 133 halfway across the top and bottom edges of the side panels. Thus, the zippers 126 and 128 are identical in shape and size to the attaching zippers composed of the elements that are secured to the carry-on and garment bags. Either of the panels 122 and 124 may be secured separately to the face of the side panels of either the carry-on or garment bags to form a thin brief case on that bag. Thus, in FIG. 9, the inside of panel 122 is shown to carry zipper elements 126*a* and 128*a* that make up one half of each zipper 126 and 128. When secured to carry-on bag 10 on panel 18, elements 126*a* and 40 would be attached as also would elements 128*a* and 42. This arrangement is shown in FIG. 12. The brief case when on the carry-on bag is opened also by means of the attaching zippers.

In certain of the drawings it will be noted that rings are attached to the bags and locks are shown for securing the attaching zippers together. These locks and rings may of course be used to insure against unauthorized separation of the bags.

It should also be appreciated that what has been termed a zipper element in the foregoing description is one strip of teeth with or without a slide to lock those teeth with a mating zipper element. The zippers must be of sound quality, but their details do not form part of this invention. It is of course understood that only one of a pair of compatable or mating elements carries a slide, and in the preferred form of this invention for maximum versatility one of the two elements on each panel that carries a pair of zipper elements includes a slide.

In the foregoing description reference has specifically been made to a carry-on bag, garment bag, tote bag, tote-size hand duffle and brief case. It will be appreciated that other types of luggage such as an overnite bag or larger or smaller carry-on bags may form part of the assembly as well. There is essentially no limit to the number of bags that may be secured together in this fashion if they are provided with compatable attaching zipper elements.

From the foregoing description it will be appreciated that the several advantages described in the introduction are derived from this invention. The bags may be used in different combinations, either separately or attached together. Preferrably the separate bags are each made of a light weight material so that the bags even when assembled together do not become unmanageably heavy. Certain of the bags are designed primarily for use only when detached from the assembly but can be carried unfilled as part of the assembly by means of the attaching zippers provided. For example, the tote-size hand duffle is primarily intended to be used in its expanded form and when expanded cannot readily be attached to the assembly.

Having described this invention in detail, those skilled in the art will appreciate that numerous modifications may be made thereof without departing from the spirit of this invention. Therefore, it is not intended that the breadth of this invention be limited to the specific embodiment illustrated and described. Rather, it is intended that the scope of this invention be determined by the appended claims and their equivalents.

I claim:

1. Modular hand luggage including a plurality of luggage pieces each capable of independent use and capable of being secured together when desired for shipping and carrying comprising, a generally rectangular first luggage piece having a pair of parallel side panels, bottom wall, a top and two ends, generally rectangular second and third luggage pieces each having a pair of parallel side panels and each capable independently of any other luggage piece of functioning as a piece of luggage for carrying clothing or other articles, one side panel of each of the second and third luggage pieces together being approximately equal to the size of the side panel of the first luggage piece so that when the second and third pieces are arranged side by side with their side panels coplanar their combined height and width dimensions approximately are the same as the height and width dimensions of the side panels of the first piece, and fastening means secured to at least one of the side panels of each of the three luggage pieces for releasably securing the second and third pieces side by side to a side panel of the first piece, said fastening means being capable of securing the second and third luggage pieces together in face to face relationship independent of the first luggage piece.

2. Modular hand luggage as defined in claim 1 further characterized by said first luggage piece being a carrying-on bag.

3. Modular hand luggage as defined in claim 1 further characterized by the fastening means comprising a zipper with mating elements of the zipper being carried on the first, second and third luggage pieces.

4. Modular hand luggage as defined in claim 3 further characterized by the zipper elements on the side panel of the first luggage piece including two separate U-shaped strips with the bites of the U-shaped strips extending adjacent the opposite ends of the side panel and the arms of the strips extending adjacent the top and bottom edges of the side panel in alignment with one another, the zipper elements on the side panels of the second and third luggage pieces comprising U-shaped strips, one on each piece, with the bite of the U on each extending vertically along one end of the side panel and the arms of the U extending horizontally along the top and bottom of the side panel.

5. A hand luggage adapted to be attached to and carry other pieces of hand luggage comprising a pair of parallel side panels, a bottom wall, a top and two ends, a first zipper element secured to the luggage adjacent a one side edge of one side panel and a second zipper element discontinuous from the first zipper element and forming part of separate zippers and secured to the luggage adjacent a second side edge of said one side panel and opposite the first side edge, said first and second zipper elements being adapted to secure other luggage pieces to the luggage, closure means independent of the first and second zipper elements for opening and closing the luggage, and a handle secured to the luggage for carrying it.

6. A hand luggage as defined in claim 5 further characterized by a slide closure carried on only one of the zipper elements.

7. A hand luaggage as defined in claim 6 further characterized by said hand luggage being a foldable garment bag with the side panels being coplanar when the bag is unfolded.

8. a hand luggage as defined in claim 6 further characterized by third and fourth zipper elements being secured to the second side panel of the luggage and being mirror images of the first and second elements on the first side panel of the luggage.

9. A hand luggage as defined in claim 8 further characterized by an additional luggage article having a side panel separate from the panels of the hand luggage and carrying zipper elements which mate with each of the zipper elements on the side panels of the hand luggage so that it may be secured to either side panel of the hand luggage.

10. A hand luggage as defined in claim 9 further characterized by said additional luggage article having closure means independent of the zipper elements for opening and closing the additional luggage article.

11. A hand luggage adapted to be attached to and carry other pieces of hand luggage comprising a pair of parallel side panels, a bottom wall, a top and two ends, a first zipper element secured to the luggage adjacent a one side edge of one side panel and a second zipper element secured to the luggage adjacent a second side edge of said one side panel and opposite the first side edge, and first and second zipper elements being adapted to secure other luggage pieces to the luggage, closure means independent of the first and second zipper elements for opening and closing the luggage, and a handle secured to the luggage for carrying it, each of said zipper elements being U-shaped, the bites of the U-shaped elements extending vertically adjacent the opposite end edges of the side panel and the arms of the U-shaped elements extending toward one another along the top and bottom side edges of the side panel and terminating at the mid-portion of those edges.

12. A hand luggage as defined in claim 11 further characterized by third and fourth zipper elements being secured to the second side panel of the luggage and being mirror images of the first and second elements on the first side panel of the luggage.

13. A hand luggage as defined in claim 12 further characterized by an additional luggage article having a side panel separate from the panels of the hand luggage and carrying zipper elements which mate with each of the zipper elements on the side panels of the hand luggage so that it may be secured to either side panel of the hand luggage.

14. A hand luggage as defined in claim 13 further characterized by said additional luggage article having closure means independent of the zipper elements for opening and closing the additional luggage article.

15. A hand luggage as defined in claim 12 further characterized by a slide closure carried on only one of the zipper elements.

16. Modular hand luggage comprising two hand luggage pieces each having sides, bottom, top and ends and capable of functioning as luggage independently of the other for carrying clothing or other articles, and fastening means secured to both sides of each of the luggage pieces enabling the two pieces to be secured together on either side of one another for carrying them as a unitary structure when they are either empty or carrying articles.

17. Modular hand luggage as defined in claim 15 further characterized by said luggage pieces being dissimilar in size.

18. Modular hand luggage as defined in claim 17 further characterized by each luggage piece having a closure independent of the fastening means, and each piece having a handle.

19. Modular hand luggage as defined in claim 18 further characterized by a third luggage piece dissimilar in size to at least one of the first and second luggage pieces, and fastening means secured to the third luggage piece for securing it to at least one of the other pieces.

20. Modular luggage as defined in claim 19 further characterized by said fastening means on the third piece being capable of selectively securing the third piece to either of the other pieces while the other pieces are either attached or detached from one another.

21. Modular luggage as defined in claim 19 further characterized by said second and third luggage pieces being substantially the same size, and said fastening means enabling the second and third pieces to be selectively secured side by side to the first piece and face to face with each other independent of the first piece.

22. Modular hand luggage as defined in claim 16 further characterized by said fastening means being zippers which extend about the periphery of the sides of each luggage piece.

23. Modular hand luggage as defined in claim 22 further characterized by handles secured to each of the pieces, the handles secured to at least one of the pieces, being secured to the sides thereof, the handle on the side of the piece secured to the other piece being confined between the secured together sides.

24. Modular hand luggage as defined in claim 16 further characterized by said fastening means being two independent zipper elements secured to each side of each of the pieces.

25. Modular hand luggage comprising three hand luggage pieces each having sides, bottom, top and ends and capable of functioning as luggage independently of the other pieces, and zipper elements secured to two sides of at least one of the pieces and zipper elements secured to at least one side of each of the other pieces enabling any two pieces to be interchangeably secured to one another and all three pieces to be secured together.

26. Modular hand luggage as defined in claim 25 further characterized by each of said three pieces being of a different size from the others.

* * * * *